US007832595B2

(12) United States Patent
Lickstein

(10) Patent No.: US 7,832,595 B2
(45) Date of Patent: Nov. 16, 2010

(54) HOUSEHOLD LIQUID DISPENSER WITH KEYED SPOUT FITMENT AND REFILL

(75) Inventor: David Lickstein, Milford, CT (US)

(73) Assignee: Conopco, Inc., Englewood Cliffs, NJ (US)

( * ) Notice: Subject to any disclaimer, the term of this patent is extended or adjusted under 35 U.S.C. 154(b) by 299 days.

(21) Appl. No.: 11/880,550

(22) Filed: Jul. 23, 2007

(65) Prior Publication Data

US 2009/0026225 A1 Jan. 29, 2009

(51) Int. Cl.
*B65D 88/54* (2006.01)

(52) U.S. Cl. ..... 222/325; 222/333

(58) Field of Classification Search ..... 222/324–328, 222/382, 383.3, 165, 321.1–321.9, 322, 372, 222/383.1, 385, 333, 100, 105, 174, 189.1, 222/330, 335, 354

See application file for complete search history.

(56) References Cited

U.S. PATENT DOCUMENTS

| | | | | | |
|---|---|---|---|---|---|
| 3,779,414 | A | | 12/1973 | Jones | |
| 4,614,437 | A | | 9/1986 | Buehler | |
| 4,781,311 | A | * | 11/1988 | Dunning et al. | 222/153.09 |
| 5,060,827 | A | | 10/1991 | Segati | |
| 5,474,212 | A | * | 12/1995 | Ichikawa et al. | 222/105 |
| 5,547,091 | A | | 8/1996 | Neveras et al. | |
| 5,845,798 | A | * | 12/1998 | Carrier | 215/330 |
| 5,845,820 | A | * | 12/1998 | Foster | 222/383.1 |
| 5,992,698 | A | * | 11/1999 | Copeland et al. | 222/180 |
| 6,015,068 | A | | 1/2000 | Osgar et al. | |
| 6,123,212 | A | | 9/2000 | Russell et al. | |
| 6,273,307 | B1 | | 8/2001 | Gross et al. | |
| 6,439,429 | B1 | | 8/2002 | Gross | |
| 6,467,651 | B1 | | 10/2002 | Muderlak et al. | |
| 6,619,505 | B1 | * | 9/2003 | Decottignies et al. | 222/95 |
| 6,786,136 | B2 | | 9/2004 | Cirigliano et al. | |
| 7,191,920 | B2 | | 3/2007 | Boll et al. | |
| 2004/0245204 | A1 | | 12/2004 | Suffa | |
| 2005/0279783 | A1 | | 12/2005 | Lo | |
| 2007/0039976 | A1 | | 2/2007 | Saleh et al. | |
| 2007/0051746 | A1 | | 3/2007 | De Laforcade | |
| 2008/0093387 | A1 | * | 4/2008 | Pivonka et al. | 222/205 |

FOREIGN PATENT DOCUMENTS

| | | |
|---|---|---|
| EP | 1 526 082 | 4/2005 |
| EP | 1 671 568 A2 | 6/2006 |
| WO | 98/45207 | 10/1998 |

OTHER PUBLICATIONS

*International Search Report*, PCT/EP2008/059189, mailed Sep. 8, 2009, 3 pp.

* cited by examiner

*Primary Examiner*—Lien T Ngo
(74) *Attorney, Agent, or Firm*—Alan A. Bornstein

(57) ABSTRACT

A household liquid dispenser has a spout fitment with discontinuous beads or screw threads which define axial channels to interface with a pump inlet in a lock and key arrangement so as to maintain consistent quality of liquids dispensed by preventing the substitution of product refills of uncertain quality. Refills may be readily manufactured and at low cost. Mechanical and motorized dispensers may be used with the inventive spout fitment.

10 Claims, 9 Drawing Sheets

HOUSEHOLD LIQUID DISPENSER WITH KEYED SPOUT FITMENT AND REFILL

BACKGROUND

1. Field of the Invention

The invention relates to a household liquid dispenser and specifically to one having a refill that is easily replaced when spent and is keyed to the dispenser.

2. Description of the Related Art

Motorized and mechanical household liquid dispensers are well known in the art. These dispensers have attempted to satisfy a number of criteria to be acceptable to consumers. These criteria include ease of dispensing, reliability of dispensing and ease in refilling the dispenser. When the dispenser is used to dispense a skin care or cleansing product, the user expects that the product dispensed will be of consistent and excellent quality for personal application to the skin. Manufacturers have sought to provide specific interfaces for refills for dispensers to assure the consumer that the product dispensed will be of the quality expected while minimizing production costs and providing easy replacement for the user. A brief representation of the prior art is set forth below.

U.S. Pat. No. 7,191,920 issued to Boll et al. on Mar. 20, 2007 discloses a household liquid dispenser that may be variously refilled by insertion of a specifically shaped refill container, insertion of a bottle or manually refilled etc.

U.S. Pat. No. 6,467,651 issued to Muderlak et al. on Oct. 22, 2002 discloses an automatic fluid soap dispensing apparatus where the replaceable reservoir and pump combination is mounted under the dispenser via a vertical male-female type connection.

However, these and other prior art devices do not incorporate structural elements that desirably provide consistent operation, easy refill replacement, low cost of manufacture and a specific keyed arrangement to prevent the substitution of low quality household liquids such as skin care and cleansing products without the desired properties that the user expects to find.

SUMMARY OF THE INVENTION

In one aspect of the invention is a household liquid dispenser, including but not limited to:

a. a housing containing a pump, a supply conduit for the pump extending into a supply compartment within the housing, and a rigid wall;

b. the rigid wall defining an aperture having a perimeter whereby the supply conduit extends through the aperture and wherein at least one rigid protuberance extends laterally into the aperture from the perimeter;

c. wherein the aperture is sized to receive a spout fitment, the spout fitment having a neck provided externally with discontinuous bead(s) extending laterally from the neck, the beads defining one or more channels;

d. wherein the protuberance is shaped to fit within the channel, thereby allowing the spout fitment to be inserted into the aperture beyond the protuberance; and e. wherein the channel extends transversely into the bead(s), the depth of the channel being perpendicular to the surface of the neck.

In another aspect of the invention is a liquid dispenser kit including but not limited to:

a. a household liquid dispenser including but not limited to i. a housing containing a pump, a supply conduit for the pump extending into a supply compartment within the housing, and a rigid wall;

ii. the rigid wall defining an aperture having a perimeter whereby the supply conduit extends through the aperture and wherein at least one rigid protuberance extends laterally into the aperture from the perimeter;

iii. wherein the aperture is sized to receive a spout fitment, and wherein the protuberance is shaped to fit within a channel on the fitment, thereby allowing the spout fitment to be inserted into the aperture beyond the protuberance;

b. a supply container connected to the spout fitment with a neck provided externally with discontinuous bead(s) on the neck's surface adapted for receiving a cap in a sealing relationship with the neck to contain a flowable liquid; and c. a removable rigid frame sized to substantially fit within the supply compartment and configured to rigidly support the spout fitment.

In a further aspect of the invention is a method for connecting a refill container to a household liquid dispenser including but not limited to the steps of:

a. inserting the refill container having a spout fitment into a support frame to form a container-frame assembly for supporting the container, wherein the spout fitment has a first end and an opposed second end, wherein the fitment is bonded to the container at the first end, wherein the spout fitment includes a neck and discontinuous bead(s) disposed on the neck adjacent to the second end, and a flange disposed around at least a portion of the neck; wherein the bead(s) define at least one axial channel;

b. inserting a supply conduit fluidly connected to a pump and extending into a supply compartment of the dispenser into the refill container via the spout fitment;

c. inserting the container-frame assembly into the supply compartment of the dispenser, wherein the supply compartment has a rigid wall, wherein the wall defines an aperture surrounded by a perimeter, wherein at least one protuberance extends laterally within the aperture from the perimeter, and d. engaging the axial channel(s) with the protuberance to allow the fitment to be inserted past the protuberance.

DETAILED DESCRIPTION OF THE INVENTION

All publications and patent applications, patents, and other references mentioned herein are incorporated by reference in their entirety.

Figure 1:
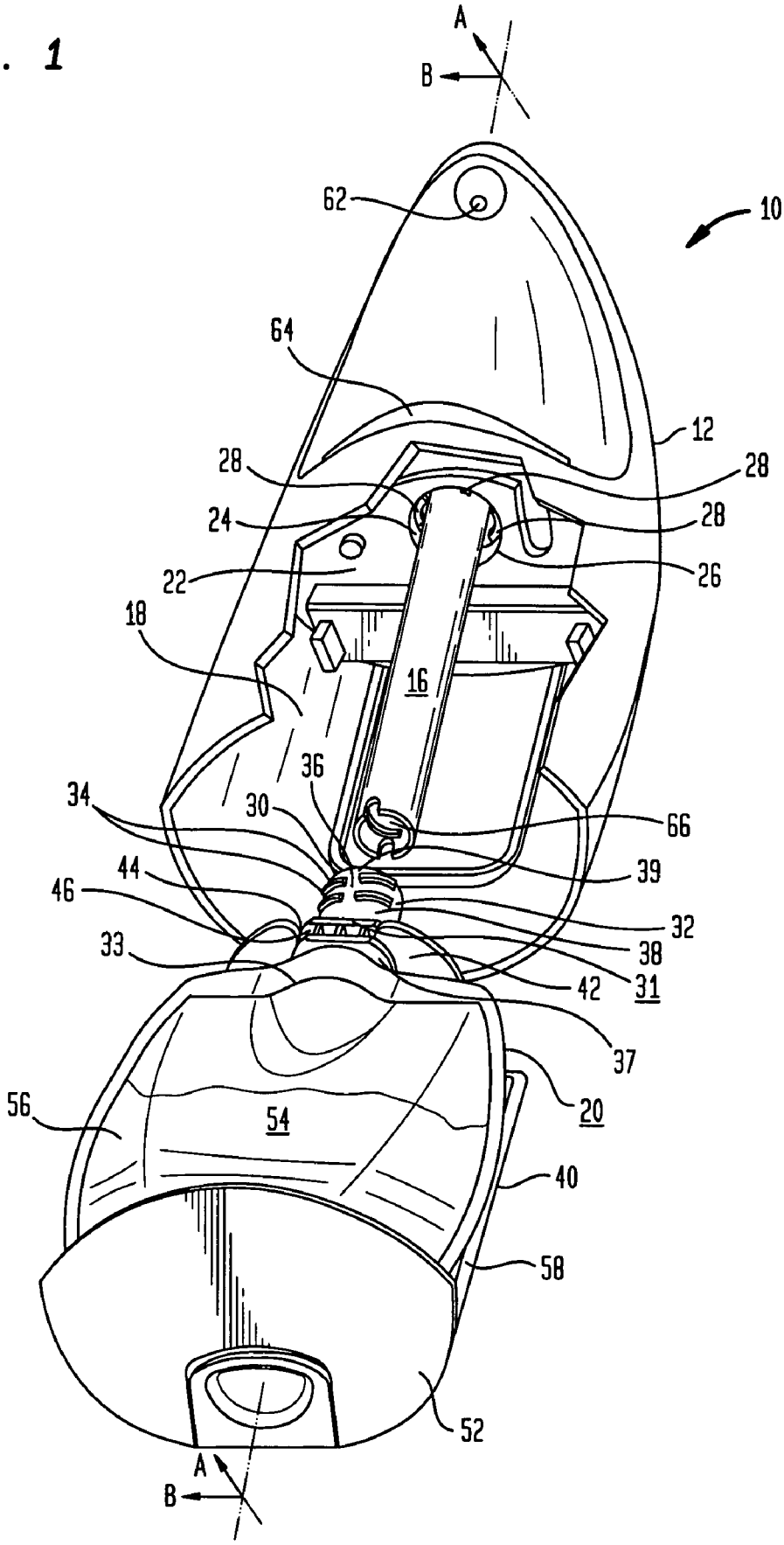
FIG. 1 is an exploded perspective view of a preferred embodiment of the household liquid dispenser, parts being broken away for clarity.

Referring now to the drawings in which like figures represent like elements, in FIG. 1 dispenser 10 is shown in the process of having supply container 20 containing a flowable household liquid 54 inserted therein. Container 20 is mounted on carrier frame 40 and the container-frame assembly is shown being received into compartment 18 defined by housing 12. Supply conduit 16 is shown being received into container 20 through orifice 39 of spout fitment 30. Supply conduit 16 is in fluid communication with pump 14 (shown in FIGS. 3 and 4) positioned within housing 12 of the dispenser. Spout fitment 30 consists of neck 32 which supports bead(s) (or screw threads) 34 and is illustrated in more detail in FIGS. 5 and 8 described below. Bead(s) 34 extend along the surface of neck 38 around its circumference in a discontinuous pattern. Gaps in beads 34 define axial channel(s) 36 which are shown receiving complementary arranged protuberances 28 extending into aperture 24 along perimeter 26. Aperture 24 is defined by perimeter 26 and rigid wall 22 located in housing 12. Carrier frame 40 supports supply container 20 via upper arm 42, side rail 58 and lower platform 52.

Figure 5:
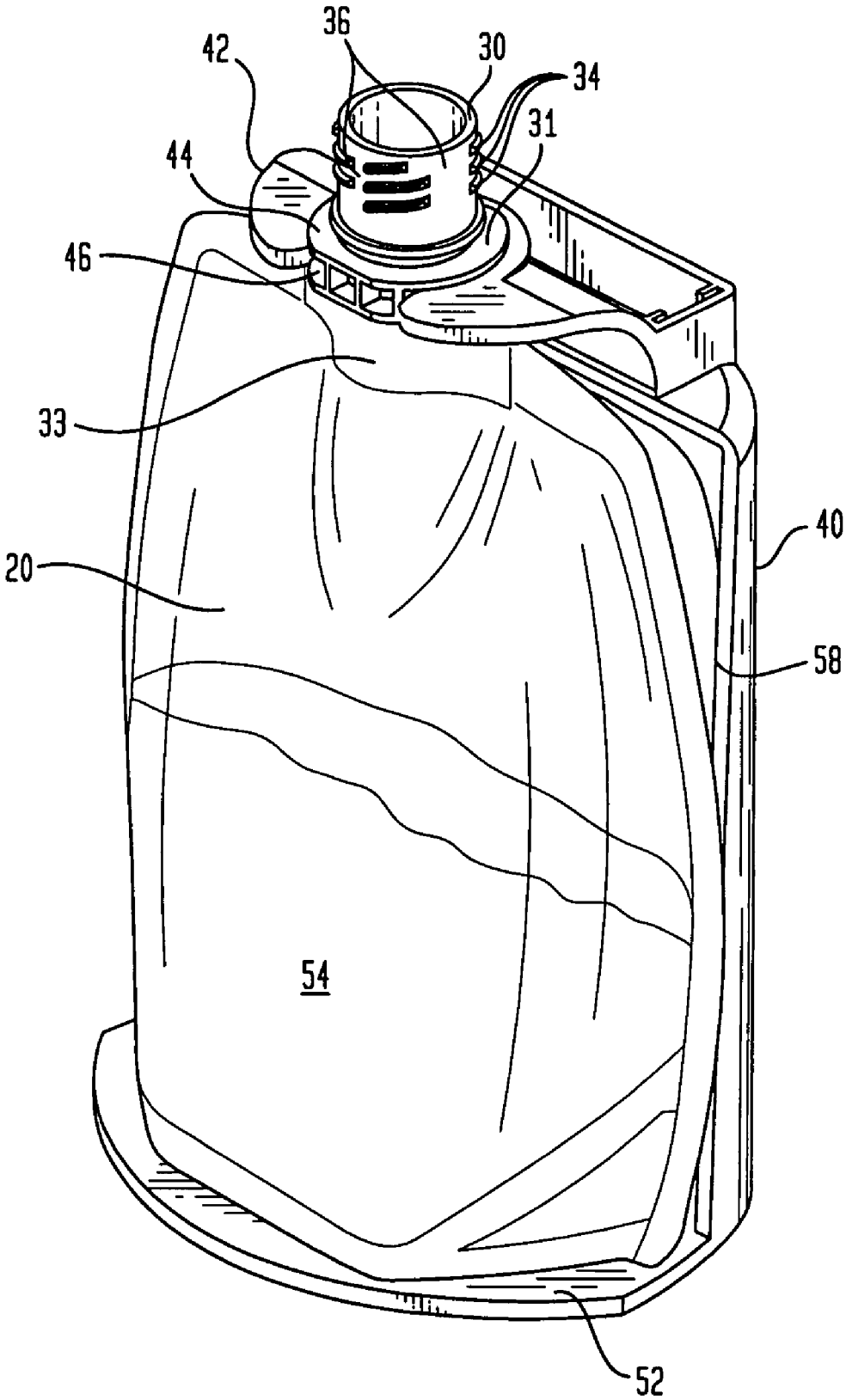
FIG. 5 is a perspective view of the supply container and frame assembly of the dispenser of FIG. 1.
Figure 6A:
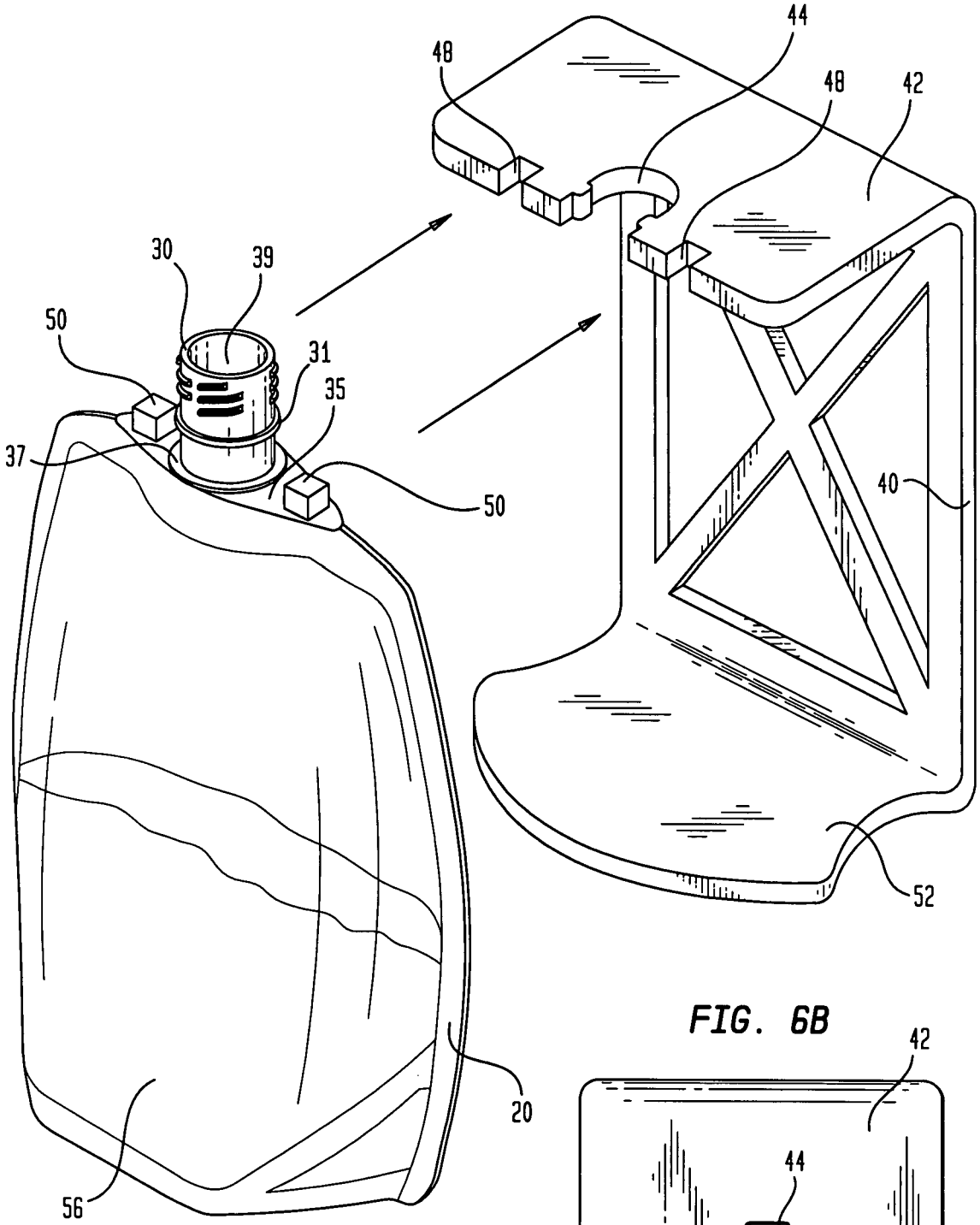
FIG. 6A is an exploded perspective view of a second preferred embodiment of the supply container and frame assembly of the dispenser of FIG. 5.

Upper arm 42 engages supply container 20 at notch 44 along groove 46 defined by spaced apart upper flange 31 and lower flange 37 shown in more detail in FIGS. 5 and 6A. In other preferred embodiments, notch 44 may have a non-circular configuration as long as it is sized to receive supply container 20 in equivalent fashion and preferably engage upper flange 31 and lower flange 37. Similarly, neck 32 of supply container 20 may also have a non-circular configuration in other preferred embodiments as long as it is sized to be received into notch 44 and receive supply conduit 16. Spout fitment 30 is bonded to container 20 via boat 33.

Figure 4:
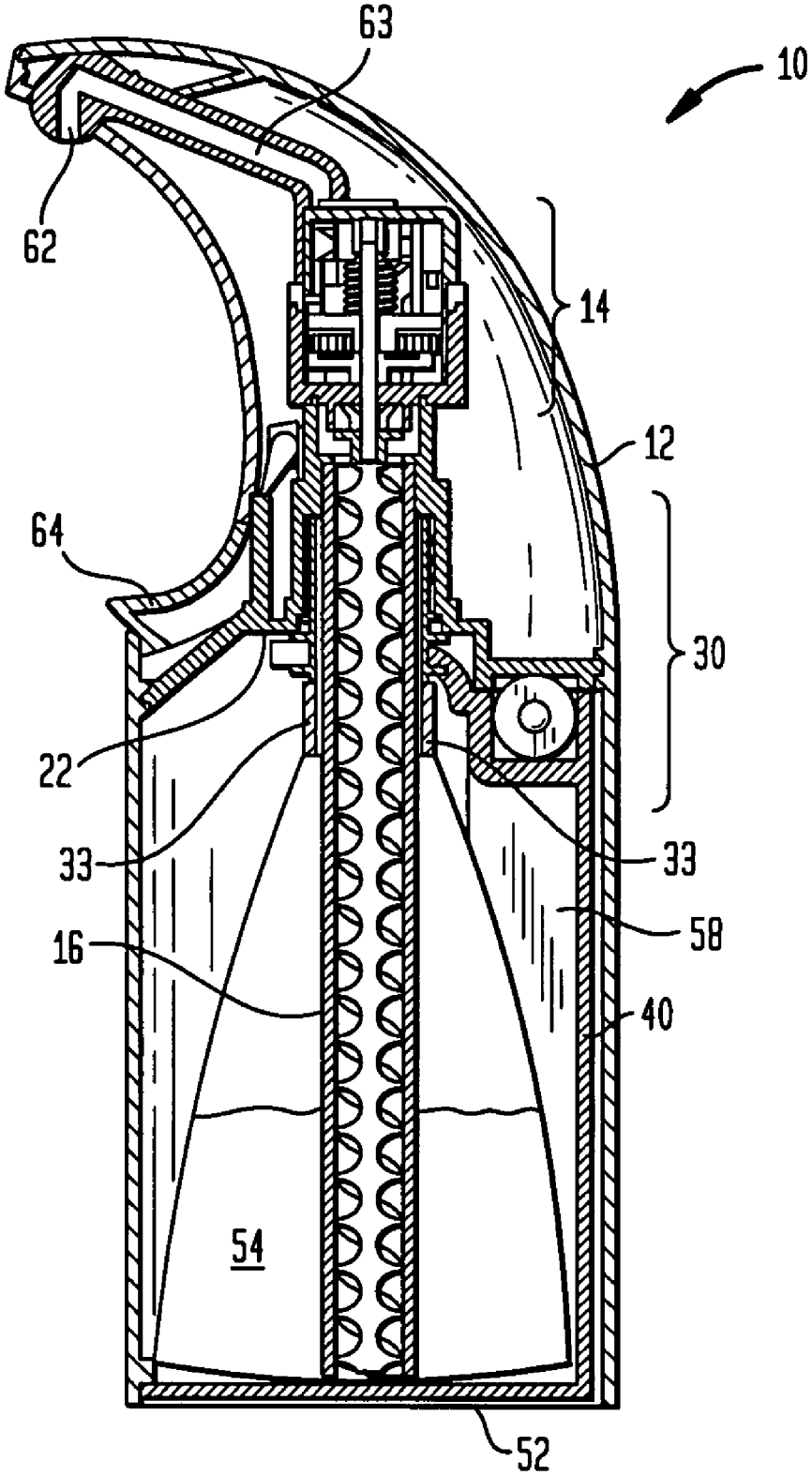
FIG. 4 is a side elevational cross-sectional view of the dispenser taken along line A-A in FIG. 1.

In operation of the dispenser 10, after supply container 20 is seated within housing 12 (e.g. as illustrated in FIG. 4), a user will engage switch 64 actuating pump 14 and rotating auger 66 so as to transport fluid 54 to pump 14 and discharge it via outlet 62. In a preferred embodiment, supply container 20 has at least one flexible wall 56. More preferably the supply container is a flexible pouch.

Figure 2:
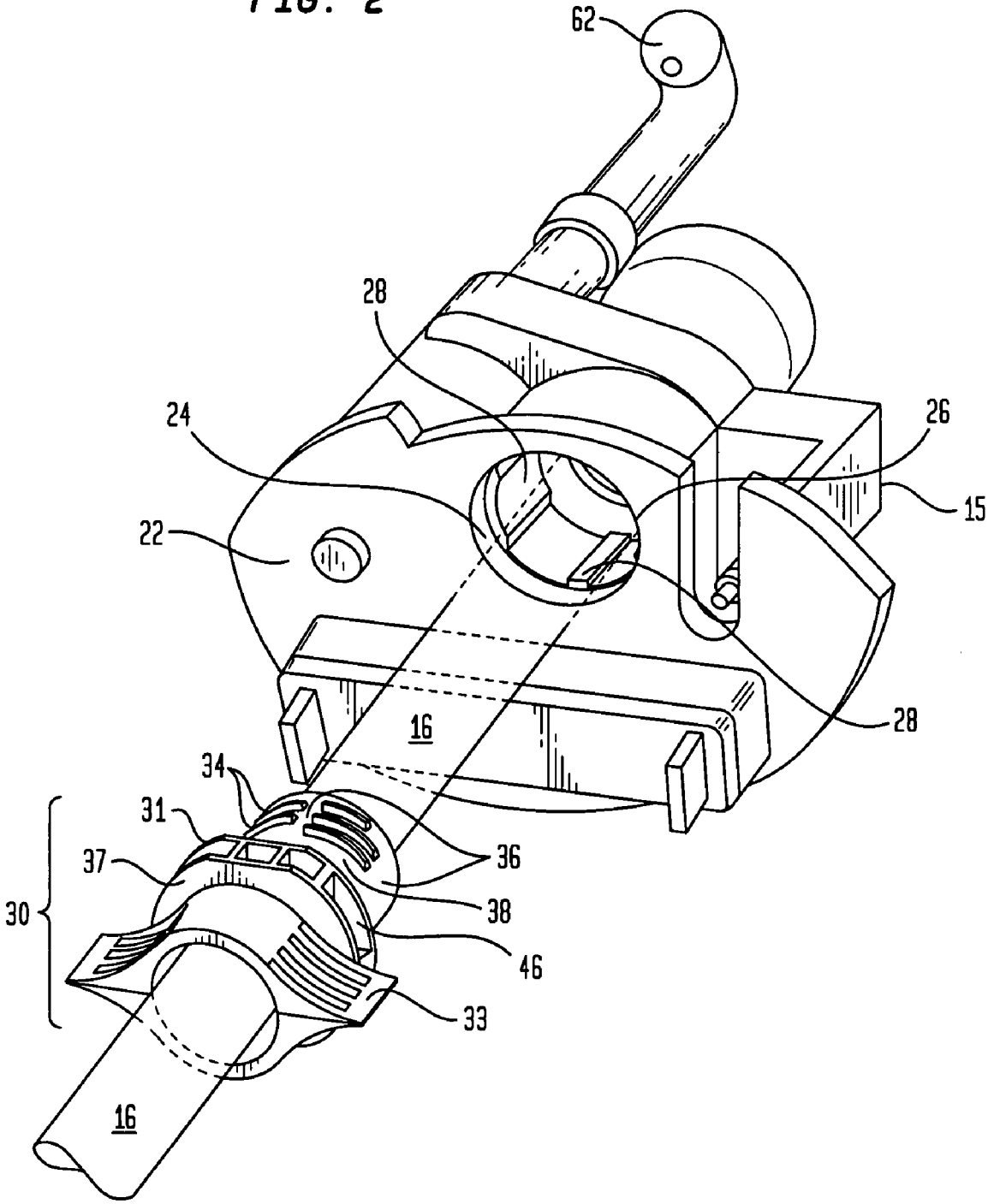
FIG. 2 is an exploded perspective view of the supply container spout fitment, pump housing and the supply tube of the dispenser of FIG. 1.

FIG. 2 shows in further detail spout fitment 30 removed from supply container 20 and simultaneously engaging supply conduit 16 which extends from pump housing 15 and where the spout fitment 30 is being received in aperture 24, while protuberances 28 are aligned with axial channels 36. Discontinuous beads 34 freely move beyond protuberances 28 during this operation. The other components of dispenser 10 are omitted for clarity.

Figure 2A:
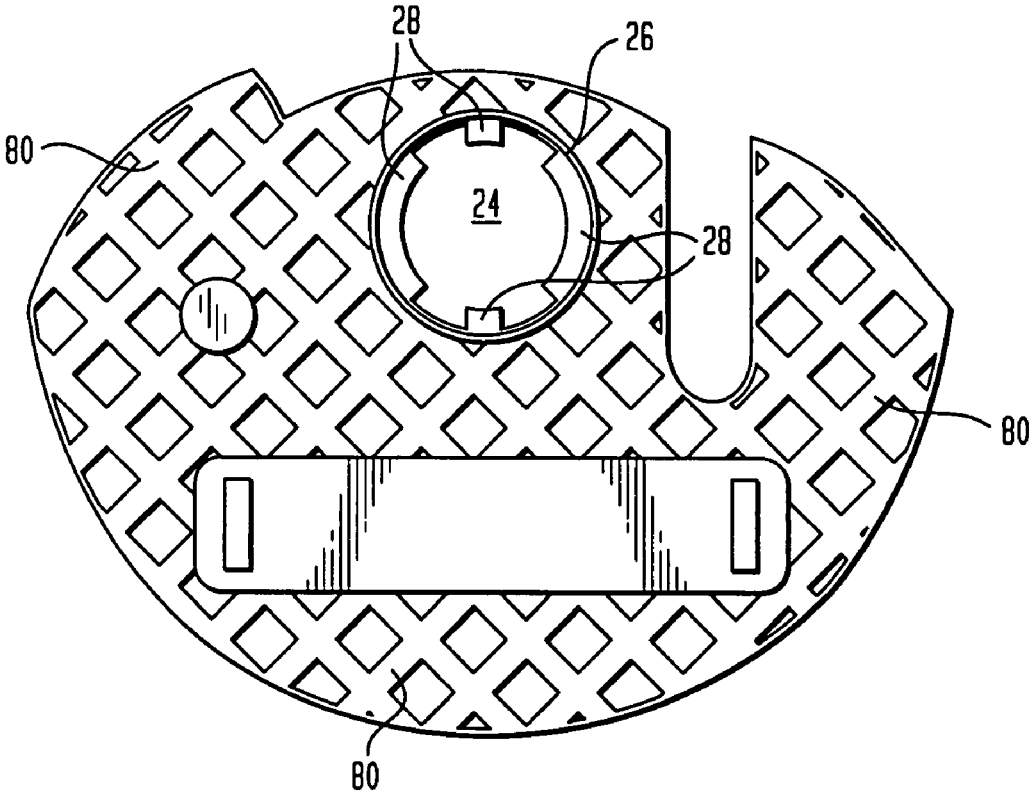
FIG. 2A is a bottom plan view of a second preferred embodiment of the rigid wall depicted in FIG. 2.
Figure 2B:
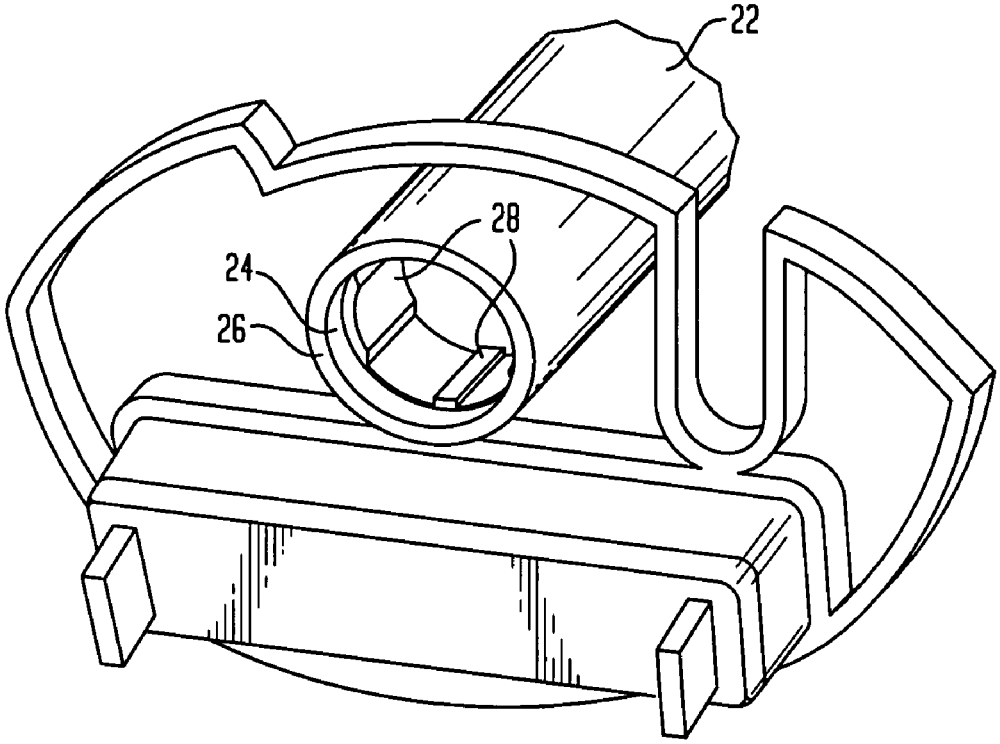
FIG. 2B is a perspective view of a third preferred embodiment of the rigid wall depicted in FIG. 2.

Now referring to FIG. 2A, rigid wall 22 may in another preferred embodiment be replaced with a latticework of support members 80 which in combination with perimeter 26 define aperture 24, which is sized to receive spout fitment 30. FIG. 2B shows a third preferred embodiment of rigid wall 22 where the wall is shown in a cylindrical configuration rigidly attached to housing 12 and positioned between pump 14 and compartment 18. As in the previously described embodiments, wall 22 supports protuberances 28 and defines aperture 24 along perimeter 26.

Figure 3:
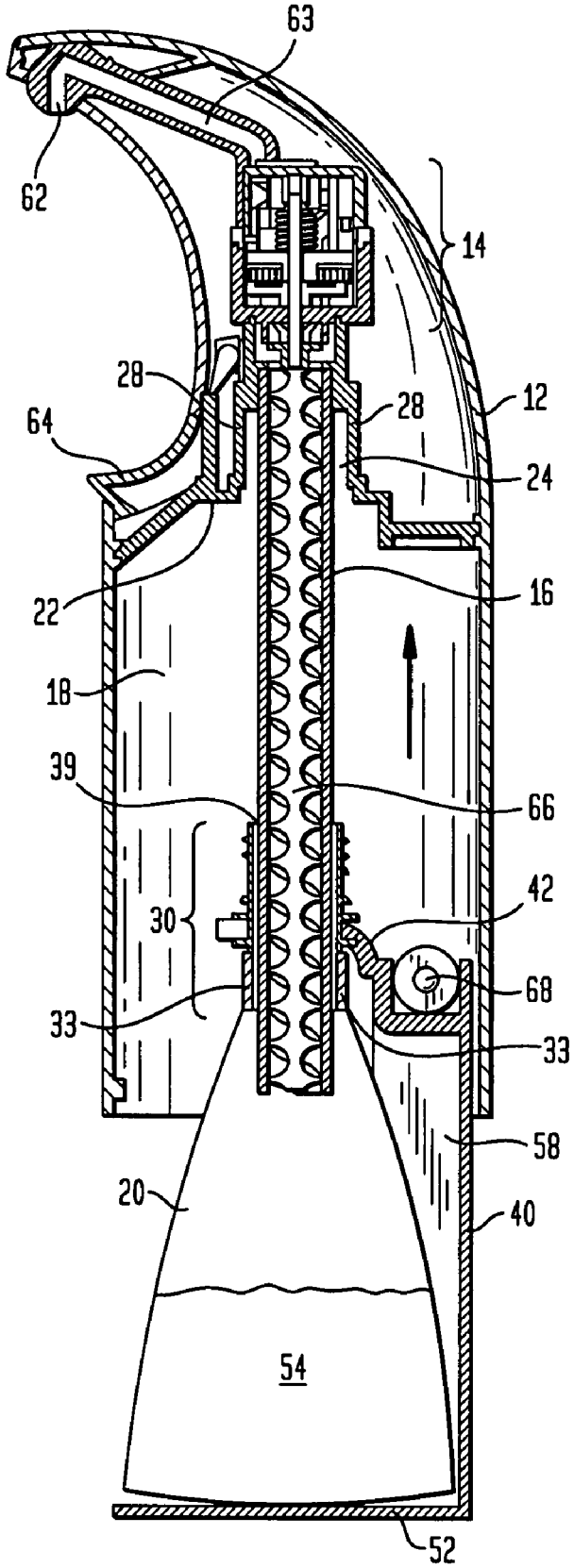
FIG. 3 is an exploded side elevational cross-sectional view of the dispenser taken along line A-A in FIG. 1.

Now referring to FIG. 3, the dispenser illustrated in FIG. 1 is depicted in a side cross-sectional view where supply tube 16 is now shown extended through spout fitment 30 part-way into supply container 20. Pump 14 is shown positioned in housing 12 and pump housing 15, and in fluid communication with supply tube 16 at its intake and with outlet conduit 63 at its outlet. Also illustrated is battery 68 which in a preferred embodiment is a power source for both pump 14 and auger rotation motor (not shown). Other power sources may be usefully employed as well as other mechanical arrangements for transporting the household liquid from the supply container to the outlet described in further detail below.

FIG. 4 shows the supply container and frame assembly of FIGS. 1 to 3 fully received within housing 12. Now referring to FIG. 5, supply container 20, spout fitment 30 and carrier frame 40 are shown in assembled form and in greater detail as illustrated in FIGS. 1 to 4.

Figure 6B:
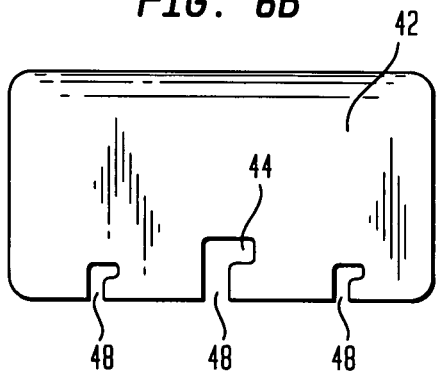
FIG. 6B is a top plan view of a third preferred embodiment of the upper frame arm of the dispenser of FIG. 5.

Now referring to FIG. 6A, a second preferred embodiment of spout fitment 30 is shown having two locking lugs 50 rigidly attached to flange extension 35 being received into carrier frame 40. In more detail, locking lugs 50 are shown being received into complementary notches 48 defined by upper arm 42 and the spout fitment 30 is shown being simultaneously received in notch 44 also defined by upper arm 42. FIG. 6B illustrates a third preferred embodiment of upper arm 42 where notches 48 and notch 44 defined by upper arm 42 all have a similar offset arrangement designed to lock spout fitment 30 securely via locking lugs 50 configured to closely fit within notches 48 and optionally closely fit within notch 44. Other configurations of locking lugs and complementary notches may be usefully employed in order to secure the spout fitment to the carrier frame.

Figure 7A:
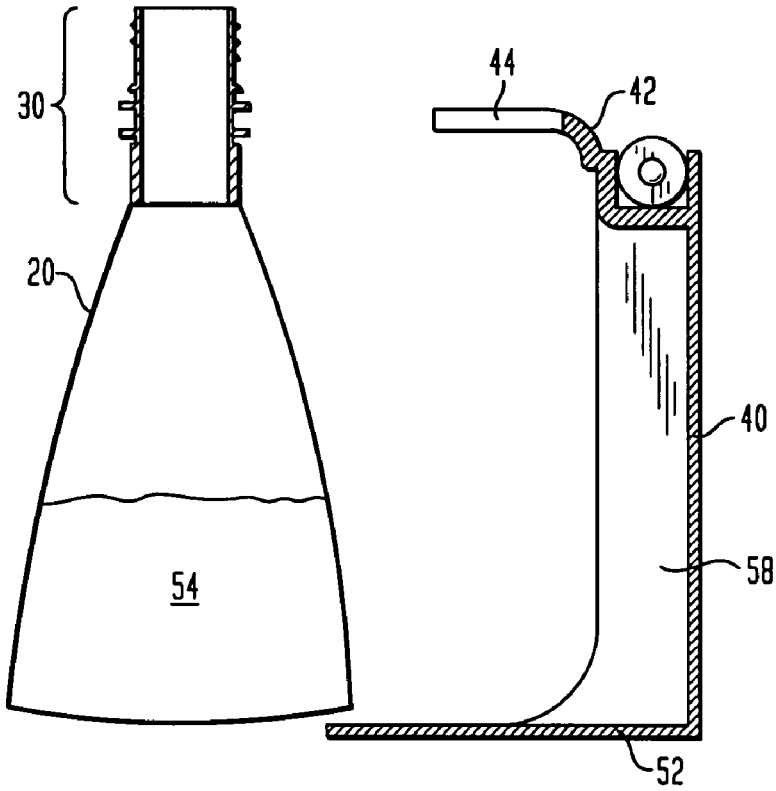
FIG. 7A is an exploded cross-sectional view of the supply container and frame assembly of the dispenser taken along line A-A in FIG. 1.
Figure 7B:
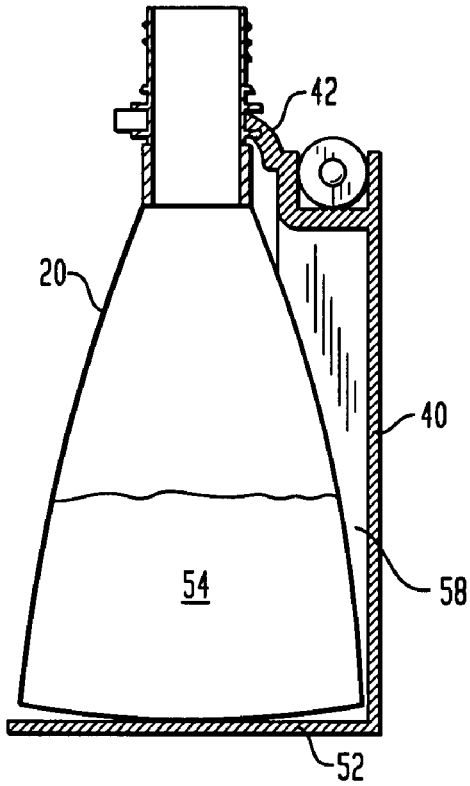
FIG. 7B is a cross-sectional view of the supply container and frame assembly of the dispenser taken along line A-A in FIG. 1.

FIG. 7 illustrates supply container 20 being received in carrier frame 40 in greater detail than is illustrated in FIGS. 1 and 2 to 6.

Figure 8:
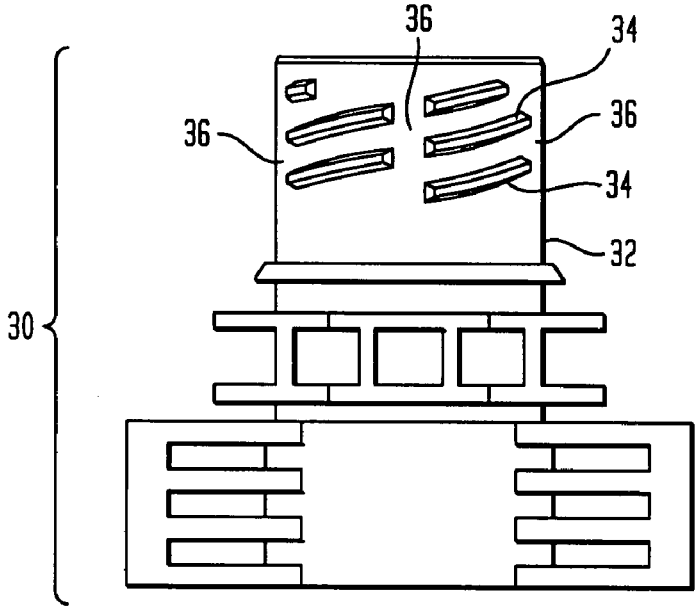
FIG. 8 is a detailed front elevational view of the spout fitment of the dispenser of FIG. 1.
Figure 9:
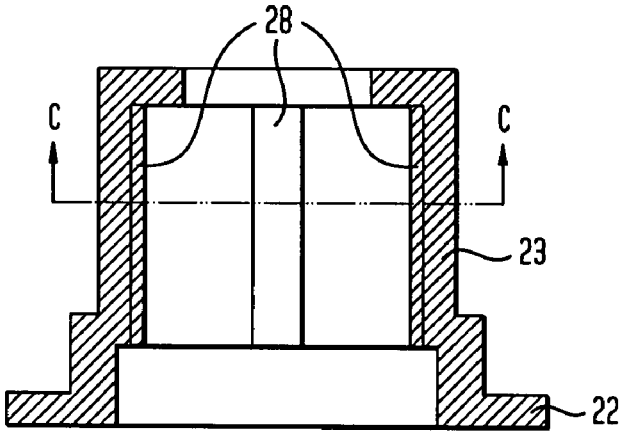
FIG. 9 is a detailed elevational cross-sectional view of the pump module cavity and adjacent surrounding structure that receives the spout fitment of FIG. 8 taken along line B-B in FIG. 1.
Figure 10:
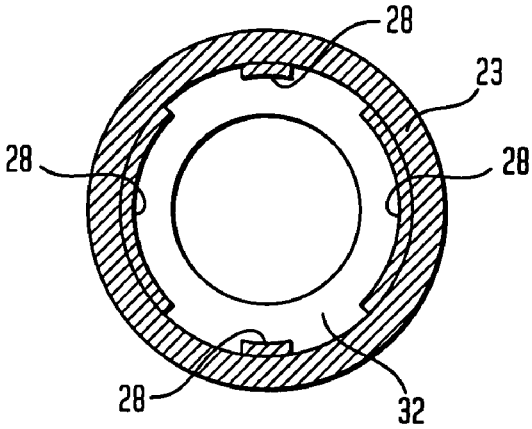
FIG. 10 is a detailed bottom cross-sectional view of the central portion of the spout fitment of FIG. 8 positioned in the pump module cavity of FIG. 9 taken along line C-C in FIG. 9.

Now referring to FIG. 8, spout fitment 30 illustrated in FIGS. 1 to 7 is shown in greater detail absent the supply container 20. Three axial channels 36 are illustrated defined by beads or screw threads 34. A fourth axial channel 36 on the reverse side of the neck 32 is not shown. Now referring to FIG. 9, the surrounding features defining aperture 24 which receives spout fitment 30 are shown in greater detail absent the other components of the dispenser 10. Upper housing wall 23 is shown fixedly supporting protuberances 28 which are configured to receive spout fitment 30 via complementary arranged axial channels 36. Now referring to FIG. 10, the condition where protuberances 28 have engaged axial channels 36 is shown in greater detail in a bottom plan view. The supply conduit 16 and the other dispenser components are omitted for clarity.

In one aspect of the invention is a household liquid dispenser, including but not limited to:

a. a housing containing a pump, a supply conduit for the pump extending into a supply compartment within the housing, and a rigid wall, preferably positioned between the pump and the supply compartment, more preferably wherein the rigid wall may be substantially solid or have an open lattice configuration or contain a combination of solid and lattice elements and advantageously where the wall may be planar, curved or cylindrical or a combination thereof;

b. the rigid wall defining an aperture having a perimeter whereby the supply conduit extends through the aperture and wherein at least one rigid protuberance (preferably two or more) extends laterally into the aperture from the perimeter, (preferably extending at least 1 mm; more preferably 1.5, or 2 mm from the perimeter), c. wherein the aperture is sized to receive a spout fitment, the spout fitment having a neck provided externally with discontinuous bead(s) extending laterally from the neck, the beads defining one or more channels;

d. wherein the protuberance is shaped to fit within the channel, thereby allowing the spout fitment to be inserted into the aperture beyond the protuberance; and e. wherein the channel extends transversely into the bead(s), the depth of the channel being perpendicular to the surface of the neck (and extending to the opposite edge of the bead(s)).

Advantageously the dispenser further includes a removable rigid frame sized to substantially fit within the supply compartment and configured to rigidly support the spout fitment. Preferably the frame fits entirely within the supply compartment. More preferably the rigid frame contains a rigid arm, the arm defining a notch that is sized to support the spout fitment via at least a portion of a flange disposed at least partially around the spout fitment (preferably circumferentially around the spout fitment, more preferably the notch is substantially rounded). Still more preferably the rigid arm defines at least one additional notch (preferably at least two additional notches) adapted to receive a shaped protuberance rigidly connected to the spout fitment (preferably in locking engagement therewith).

Advantageously the dispenser further includes a supply container, the container having a spout fitment with a neck provided externally with discontinuous bead(s) on the neck's surface preferably adapted for receiving a cap in a sealing relationship with the neck to contain a flowable liquid. Preferably the beads are screw threads adapted for receiving a screw cap with complementary threads. More preferably the supply container has at least one flexible wall. Most preferably the container is a flexible pouch. Advantageously the container is bonded to the spout fitment preferably by an adhesive seal, induction seal, heat seal, or an ultrasonic seal or a combination thereof. More preferably a heat seal is used.

In another aspect of the invention is a liquid dispenser kit including but not limited to:

a. a household liquid dispenser including but not limited to i. a housing containing a pump, a supply conduit for the pump extending into a supply compartment within the housing, and a rigid wall;

ii. the rigid wall defining an aperture having a perimeter whereby the supply conduit extends through the aperture and wherein at least one rigid protuberance extends laterally into the aperture from the perimeter;

iii. wherein the aperture is sized to receive a spout fitment, and wherein the protuberance is shaped to fit within a channel on the fitment, thereby allowing the spout fitment to be inserted into the aperture beyond the protuberance;

b. a supply container connected to the spout fitment with a neck provided externally with discontinuous bead(s) on the neck's surface adapted for receiving a cap in a sealing relationship with the neck to contain a flowable liquid; and c. a removable rigid frame sized to substantially fit within the supply compartment and configured to rigidly support the spout fitment.

In a further aspect of the invention is a method for connecting a refill container to a household liquid dispenser including but not limited to the steps of:

a. inserting the refill container having a spout fitment into a support frame to form a container-frame assembly for supporting the container, wherein the spout fitment has a first end and an opposed second end, wherein the fitment is bonded to the container at the first end, wherein the spout fitment includes a neck and discontinuous bead(s) disposed on the neck adjacent to the second end, and a flange disposed around at least a portion of the neck; wherein the bead(s) define at least one axial channel;

b. inserting a supply conduit fluidly connected to a pump and extending into a supply compartment of the dispenser into the refill container via the spout fitment;

c. inserting the container-frame assembly into the supply compartment of the dispenser, wherein the supply compartment has a rigid wall, wherein the wall defines an aperture surrounded by a perimeter, wherein at least one protuberance extends laterally within the aperture from the perimeter, and d. engaging the axial channel(s) with the protuberance to allow the fitment to be inserted past the protuberance. The situation of being inserted past the protuberance is advantageously done with negligible force such as below 1 Kg, more preferably less than 0.5, 0.2, 0.1, 0.05 or 0.01 Kg of force.

Any suitable closure such as a screw cap, a press-fit cap or a plug seal, or equivalents and combinations thereof, can be used to seal supply container 20 to contain the contents of the container prior to its being loaded into the dispenser. Preferably a tamper evident seal will be used. The dispenser pump can be any mechanism suitable for dispensing the fluid from the supply container 20. Such mechanisms may include motorized and/or mechanical designs classified as positive displacement pumps and would include multiple/single rotor, reciprocating, diaphragm, and piston pumps and combinations and equivalents thereof. It is known that reciprocating pumps deliver a pulsating flow while rotor pumps deliver a continuous flow both of which are acceptable for the present invention. Transport of the household liquid to the pump intake can be by any suitable means including the use of an auger type device, or vacuum, pressure, mechanical or peristaltic compression means, or combinations and equivalents thereof.

The embodiments of FIGS. 1 to 10 with respect to the arrangement of protuberances and axial channels may of course be modified in number and shape so long as they complement each other. Complement is herein defined as where the neck slides past the protuberances with negligible force as defined above when the axial channels are aligned with the protuberances but does not readily slide past the protuberances with negligible force when the axial channels are not aligned with the protuberances. In other words, a force greater than negligible force would be required to force the fitment past the protuberances if there were either no axial channels present or the channels were not aligned with the protuberances. Moreover this would likely result in deformation or damage to the bead(s), protuberances or other structures of the dispenser or fitment.

The foregoing description illustrates selected embodiments of the present invention. In light thereof variations and modifications will be suggested to one skilled in the art, all of which are within the scope and spirit of this invention.

I claim:

1. A household liquid dispenser, comprising:

a. a housing containing a pump, a supply conduit for the pump extending into a supply compartment within the housing, a removable rigid frame sized to substantially fit within the supply compartment and configured to rigidly support a spout fitment, and a rigid wall;

b. the rigid wall defining an aperture having a perimeter whereby the supply conduit extends through the aperture and wherein at least one rigid protuberance extends laterally into the aperture from the perimeter;

c. wherein the aperture is sized to receive the spout fitment, the spout fitment having a neck provided externally with discontinuous bead(s) extending laterally from the neck, the beads defining one or more (axial) channels;

d. wherein the protuberance is shaped to fit within the axial channel, thereby allowing the spout fitment to be inserted into the aperture beyond the protuberance where the neck slides past the protuberance with negligible force when the axial channels are aligned with the protuberance, but does not readily slide past the protuberance with neglible force when the axial channels are not aligned with the protuberance;

e. wherein the axial channel extends transversely into the bead(s), the depth of the channel being perpendicular to the surface of the neck; and, f. wherein the rigid frame and supported spout fitment assembly is configured to be simultaneously, unidirectionally, and slidably received into the housing while the supply conduct is slidably received inside the neck.

2. The dispenser of claim 1 wherein the rigid frame contains a rigid arm, the arm defining a notch that is sized to support the spout fitment via at least a portion of a flange disposed at least partially around the spout fitment.

3. The dispenser of claim 2 wherein the rigid arm defines at least one additional notch adapted to receive a shaped protuberance rigidly connected to the spout fitment.

4. The dispenser of claim 1 further comprising a supply container, the container having a spout fitment with a neck provided externally with discontinuous bead(s) on the neck's surface.

5. The dispenser of claim 4 wherein the supply container has at least one flexible wall.

6. The dispenser of claim 5 wherein the container is bonded to the spout fitment.

7. A method for connecting a refill container to a household liquid dispenser comprising the steps of:

a. inserting the refill container having a spout fitment into a support frame to form a container-frame assembly for supporting the container, wherein the spout fitment has a first end and an opposed second end, wherein the spout fitment is bonded to the container at the first end, wherein the spout fitment includes a neck and discontinuous bead(s) disposed on the neck adjacent to the second end, and a flange disposed around at least a portion of the neck: wherein the bead(s) define at least one axial channel;

b. inserting a supply conduit fluidly connected to a pump and extending into a supply compartment of the dispenser into the refill container via the spout fitment;

c. inserting the container-frame assembly into the supply compartment of the dispenser, wherein the supply compartment has a rigid wall, wherein the wall defines an aperture surrounded by a perimeter, wherein at least one protuberance extends laterally within the aperture from the perimeter, and d. engaging the axial channel(s) with the protuberance to allow the fitment to be inserted past the protuberance.

8. The dispenser of claim 1 wherein the pump is a motorized mechanism.

9. The dispenser of claim 8 wherein the pump is powered by a battery.

10. The dispenser of claim 9 where the battery is held by the removable rigid frame.

* * * * *